US005711704A

United States Patent [19]

Hughes et al.

[11] Patent Number: 5,711,704

[45] Date of Patent: Jan. 27, 1998

[54] COIN STORAGE AND DISPENSING APPARATUS

[75] Inventors: John Barry Hughes, Winston Hills; Walter James Tuffs, Epping, both of Australia

[73] Assignee: Aristocrat Leisure Industries Pty. Ltd., Rosebery, Australia

[21] Appl. No.: 596,123

[22] PCT Filed: Aug. 11, 1994

[86] PCT No.: PCT/AU94/00467

§ 371 Date: Jun. 10, 1996

§ 102(e) Date: Jun. 10, 1996

[87] PCT Pub. No.: WO95/05645

PCT Pub. Date: Feb. 23, 1995

[30] Foreign Application Priority Data

Aug. 12, 1993 [AU] Australia ..... PM 0534

[51] Int. Cl.[6] ..... G07D 1/00

[52] U.S. Cl. ..... 453/57; 221/197

[58] Field of Search ..... 453/32, 33, 34, 453/35, 49, 57; 221/197, 267

[56] References Cited

U.S. PATENT DOCUMENTS 3,669,260 6/1972 Hoppmann et al. ..... 221/169 X
4,869,394 9/1989 Hurst ..... 221/197 X
4,943,258 7/1990 Abe ..... 221/267 X
5,046,989 9/1991 Dass ..... 453/17

FOREIGN PATENT DOCUMENTS

71564/74 12/1977 Australia .
1445089 8/1976 United Kingdom ..... 453/33

OTHER PUBLICATIONS

Patent Abstracts of Japan, P 1607, p. 18, JP.A, 5–120508 (Omron Corp), May 18, 1993.
Patent Abstracts of Japan, C 1059, p. 143, JP.A, 5–181 (Orinpia K.K.), Jan. 8, 1993.

*Primary Examiner*—F. J. Bartuska
*Attorney, Agent, or Firm*—Jacobson, Price, Holman & Stern, PLLC

[57] ABSTRACT

A coin dispensing apparatus having a cylindrical hopper, the axis of which extends vertically, the bottom of the hopper being closed by a base above which is arranged a rotatable coin disc having circumferentially spaced holes for the receipt of coins, the base being provided with a coin exit slot through which coins are delivered, the base being supported on a plinth containing a driving motor for rotating the coin dis. The base is removable secured to the plinth from which it is readily removably together with the hopper and the coin disc. A device which on removal and replacement of the base from the plinth brings the coin disc automatically into engagement with the driving motor.

8 Claims, 7 Drawing Sheets

COIN STORAGE AND DISPENSING APPARATUS

The present invention relates to a coin storage and dispensing apparatus having a vertical axis hopper of the kind described in the specification of International Patent Application PCT/US89/03493 and in U.S. Pat. No. 5,046,989.

These specifications describe a coin storage and dispensing apparatus comprising a cylindrical open topped coin hopper mounted on a hopper base and having a rotatable coin disc having a plurality of coin pockets in the bottom of the hopper, the hopper base being provided with a coin gutter for receiving coins from the coin pockets and a motor to drive the coin disc, the hopper being arranged to deliver coins to a vertically extending coin track from an upper end of which coins are dispensed.

The object of the present invention is to provide a similar apparatus having significantly improved constructional features. One problem that occurs with the known apparatus is that the hopper, the hopper base and the driving motor are constructed as a unit and are firmly secured to the apparatus with which they are being used. The result of this is that, if servicing is to be carried out in the working area of the hopper the mass of coins have to be removed by hand to deal with the problem. It is convenient to be able to remove the hopper with coins in it for weighing to ascertain the monetary value of the coins in the hopper. With the arrangement described above the whole assembly has to be removed which is heavy and cumbersome and involves the unplugging of electrical connections.

The present invention overcomes these problems by providing a construction in which the hopper bowl by itself is detachable and can be readily removed when filled with coins for weighing or servicing. The present invention provides other advantageous features which are set out in the following description of a preferred embodiment of the invention.

The present invention consists in a coin dispensing apparatus having a cylindrical hopper an axis of which extends vertically, the bottom of the hopper being closed by a base above which is arranged a rotatable coin disc having circumferentially spaced holes for the receipt of coins, the base being provided with a coin exit slot through which coins are delivered, the base being supported on a plinth containing a driving motor and driving means for rotating the coin disc, characterised in that the base is removably secured to the plinth from which it is adapted to be readily removed together with the hopper and the coin disc and means which on removal and replacement of the base from the plinth bring the coin disc automatically into engagement with the driving means in the plinth.

It is preferred that means are provided whereby the spacing between the underside of the coin disc and the base may be adjusted to suit coins of different thicknesses.

In order that the nature of the invention may be better understood a preferred form thereof is hereinafter described by way of example with reference to the accompanying drawings, in which.

Figure 1:
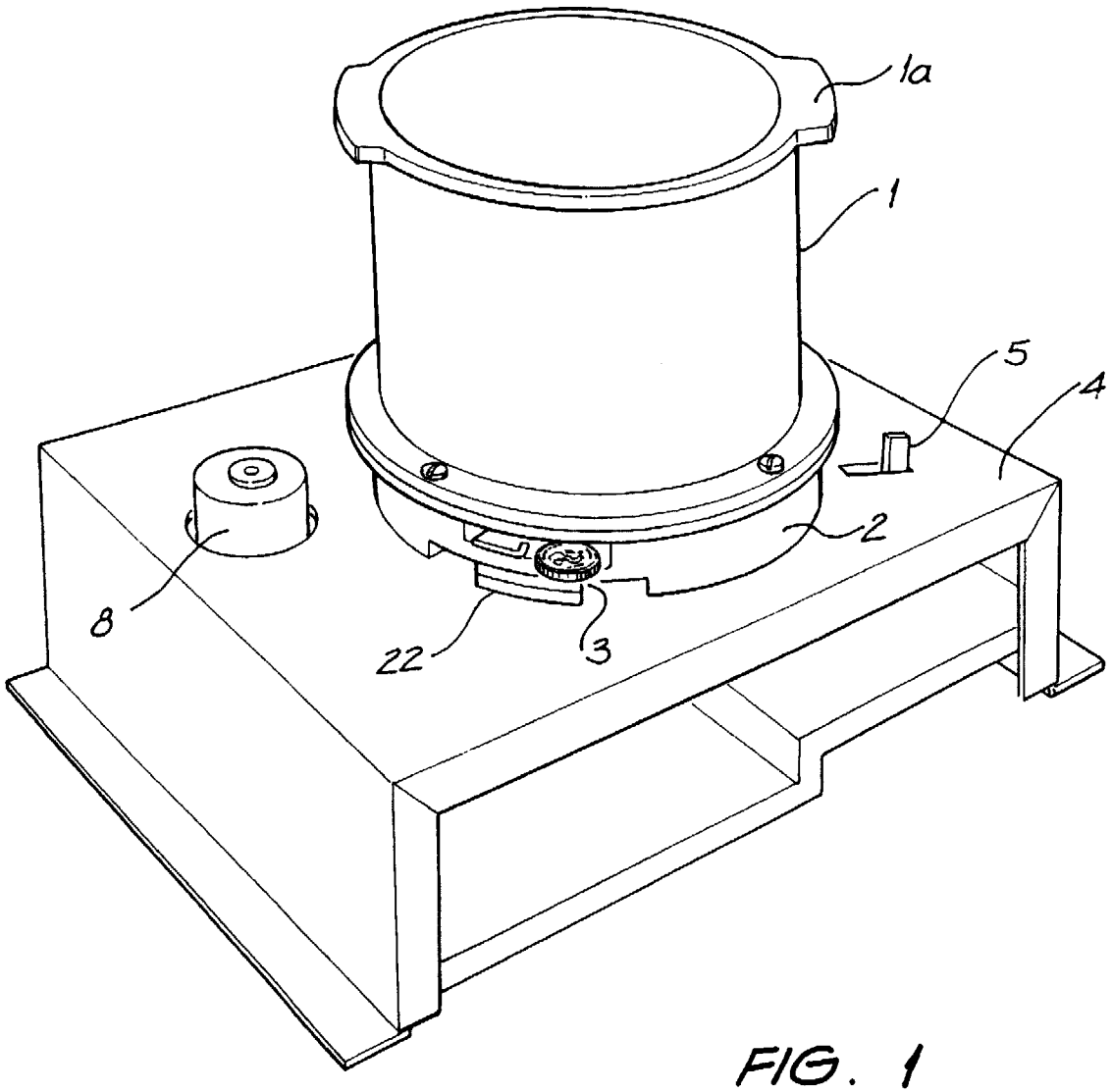
FIG. 1 is a perspective view of the assembled coin storage and dispensing apparatus.
Figure 2:
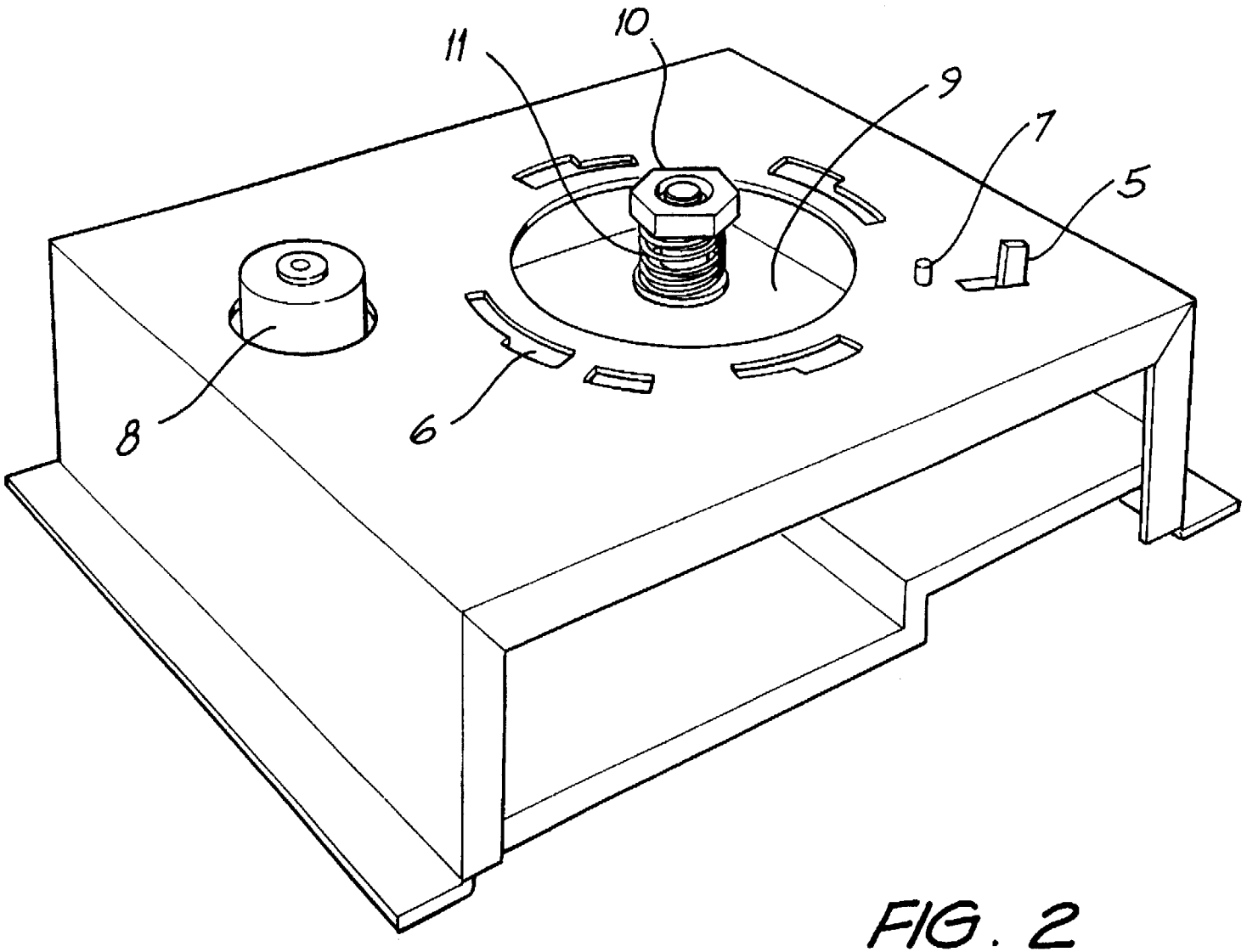
FIG. 2 is a perspective view of the plinth on which the hopper is mounted.
Figure 3:
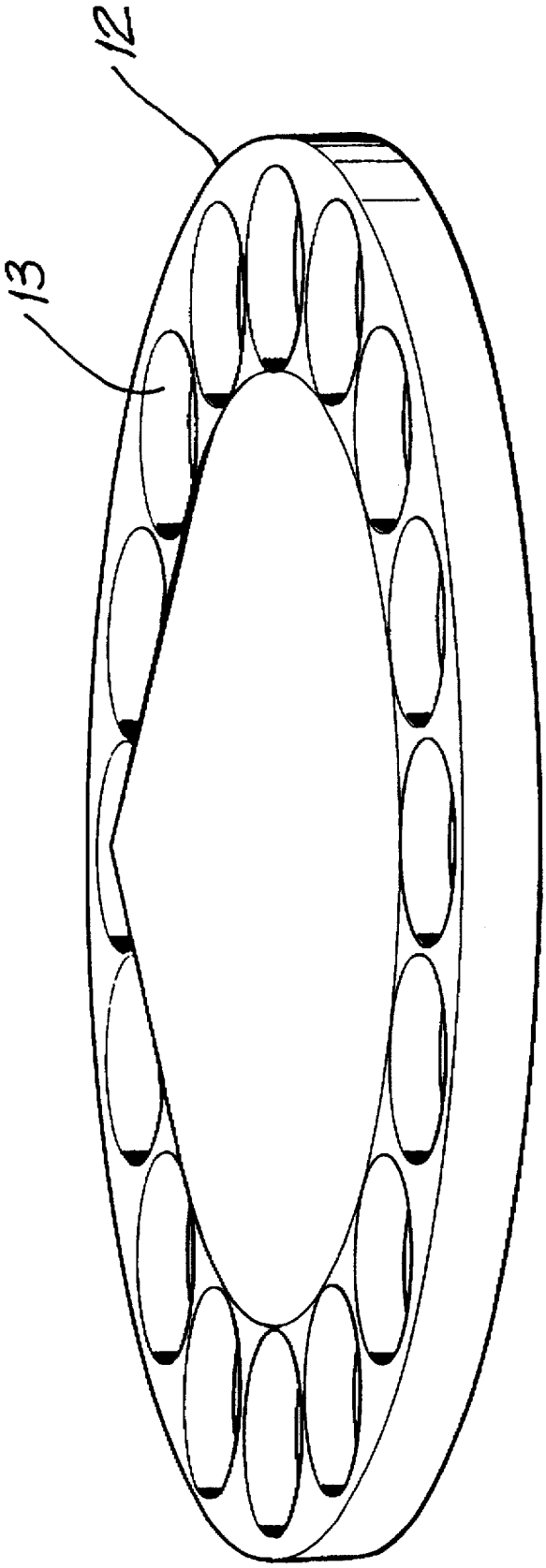
FIG. 3 shows the coin disc with holes to receive coins.
Figure 4:
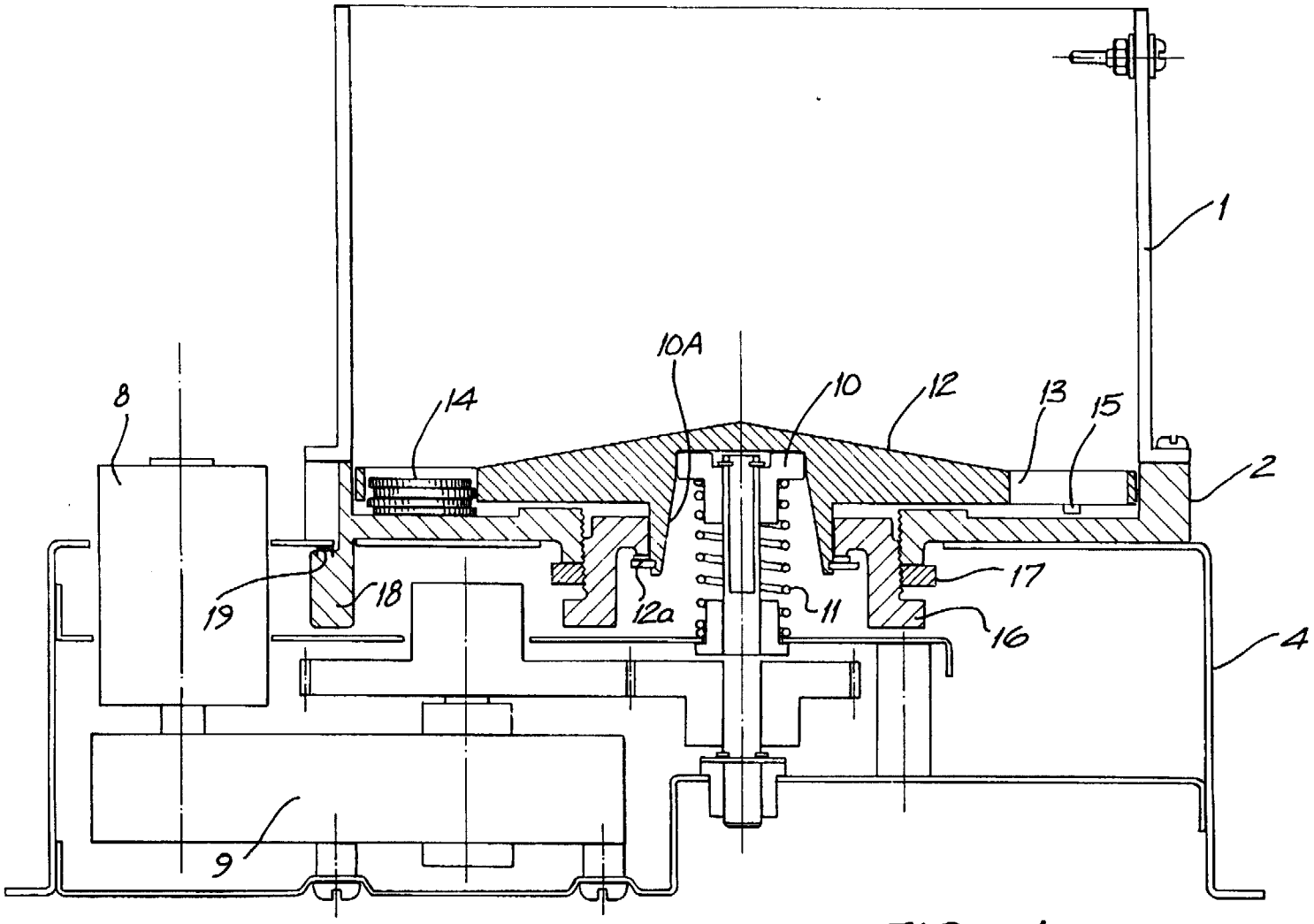
FIG. 4 is a sectional elevation of the coin storage and dispensing apparatus.

As is best seen in FIGS. 1 and 4 a coin storage and dispensing apparatus according to the invention consists of a cylindrical hopper 1 from the upper edge of which lifting handles 1A project. Mopper 1 is secured to a circular base 2 which has in its circumference a coin exit slot 3, the base 2 being mounted on a plinth 4 containing a drive motor 8 and a reduction gear box 9.

The base 2 and with it the hopper bowl 1 are secured to the plinth by means of the key-hole slots 6. Lugs 18 formed on the underside of the base 2 fit into the key hole slots and rotation of the base 2 locks the base and hopper assembly into position on the plinth. It is held in this position by means of the pin 7 which may be lowered by operation of the lever 5 thus allowing the base and hopper bowl to be rotated and easily removed from the plinth. The lugs 18 are provided on upper surfaces with leaf springs 19 which ensure a snug fit to the underside of the plinth 4.

Within the hopper bowl 1 is a rotatable coin disc 12 with holes 13 to receive coins from the bowl 1. The coin disc 12 has on its underside an hexagonal recess formed at the top of the upwardly tapering skirt 10*a* which, in replacement of the bowl on the plinth guides the hexagonal recess onto the hexagonal drive member 10 which is driven from the motor 8 through the reduction gear 9. The drive member 10 is mounted on a square section shaft and is held against the underside of the coin disc 12 by means of the spring 11.

The spacing between the coin disc 12 and the plate 2 is adjustable by means of a threaded bush 16 which engages a thread in the base 2 and engages an external flange on the skirt 12A of the coin disc 12. By rotation of the bush 16 the space between the underside of the coin disc 12 and the base 2 can be adjusted to suit coins of different thicknesses. The threaded bush 16 may be locked into position by the locking ring 17.

The upper surface of the base 2 supports coins 14 carried round in holes 13 in the coin disc 12. There is thus a pile of coins in each of the holes 13 the bottom one of which is driven by one of the pegs 15 of which one is provided between each pair of coin holes 13.

Figure 6:
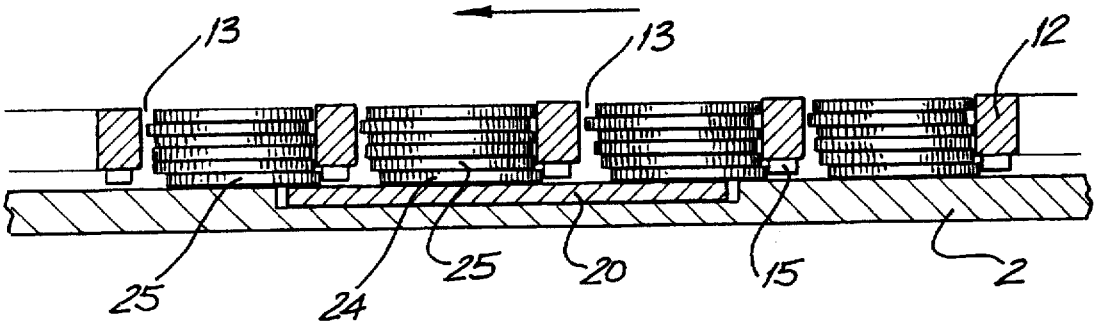
FIG. 6 is a cross-section on line A—A of FIG. 5.

The base 2 is provided with an exit slot leading to the exit plate 20. FIG. 6 shows a cross-section through the exit plate 20 and a number of coin holes 13 in the coin disc 12. The coins are supported on the top surface of the base 2 until the exit plate 20 is reached. The bottom coin 24 becomes driven by the peg 15 between the coin holes whereas the coins above it remain driven by the coin holes. A coin such as 24 (FIG. 6) is forced in a tangential direction still carrying the stack of coins above it. The coin above 25 and the stack of coins continue in their circular path. The carrying of this stack becomes gradually transferred from the exiting coin to the top surface of the base 2 and these are carried around for the next revolution. Coins hesitating at the mouth of the exit due to lessening contact of pushing pegs 15 become pushed out by the following coin. This is illustrated in FIG. 7.

Figure 7:
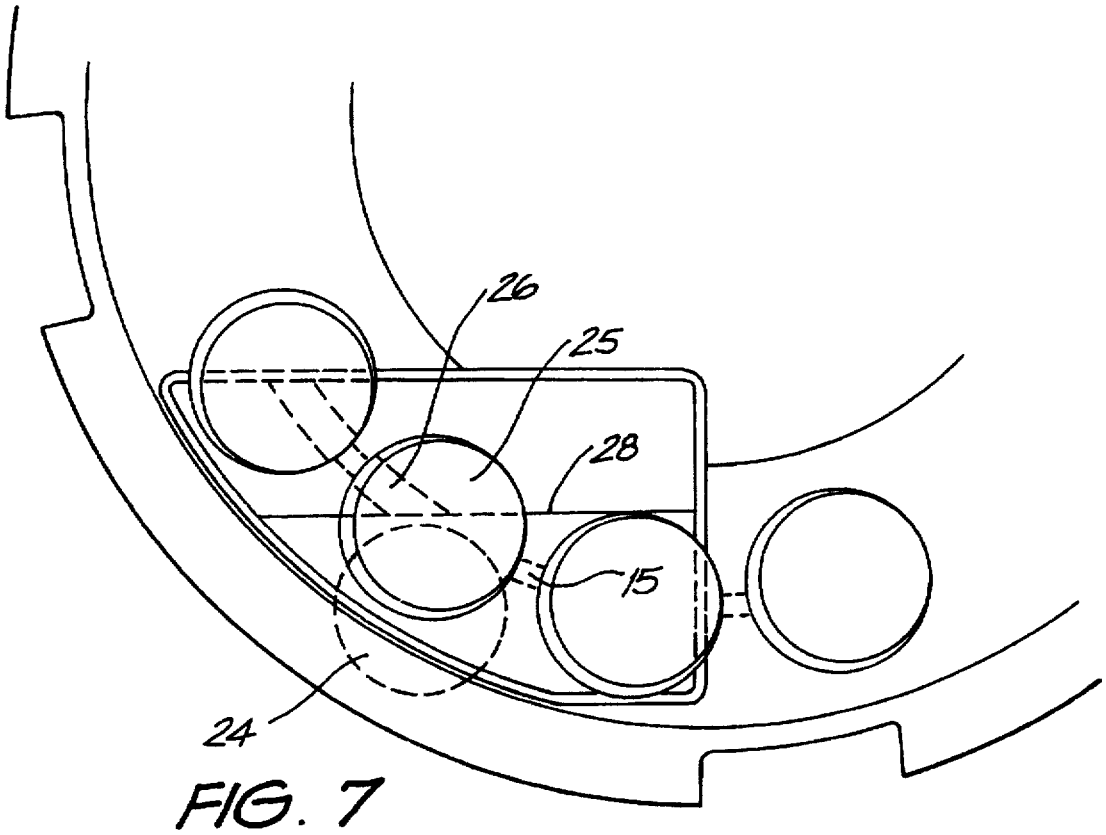
FIG. 7 is a fragmentary plan view of a portion of the coin disc and base illustrating the manner in which coins are dispensed.
Figure 10:
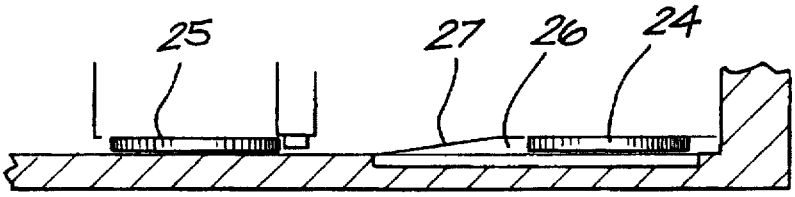
FIG. 10 is a fragmentary cross-sectional view of the plate on line B—B of FIG. 5 exit.

As seen in FIGS. 6 and 7 there is a groove 26 in the base 2 along which pins 15 pass. As the stacks of coins pass over the exit plate 20 the bottom coin 24 moves radially outwardly down the slope 27 of the exit plate 20 (FIG. 10) under the influence of the sidewall 28. The coin 25 and the stack of coins above it are lowered by the thickness of one coin as they leave the exit plate 20.

By reason of the arrangement of the key hole slot 6 the hopper bowl and base may be assembled to the plinth with the exit plate 20 pointing in any one of four different directions to suit installation in any particular apparatus.

Figure 5:
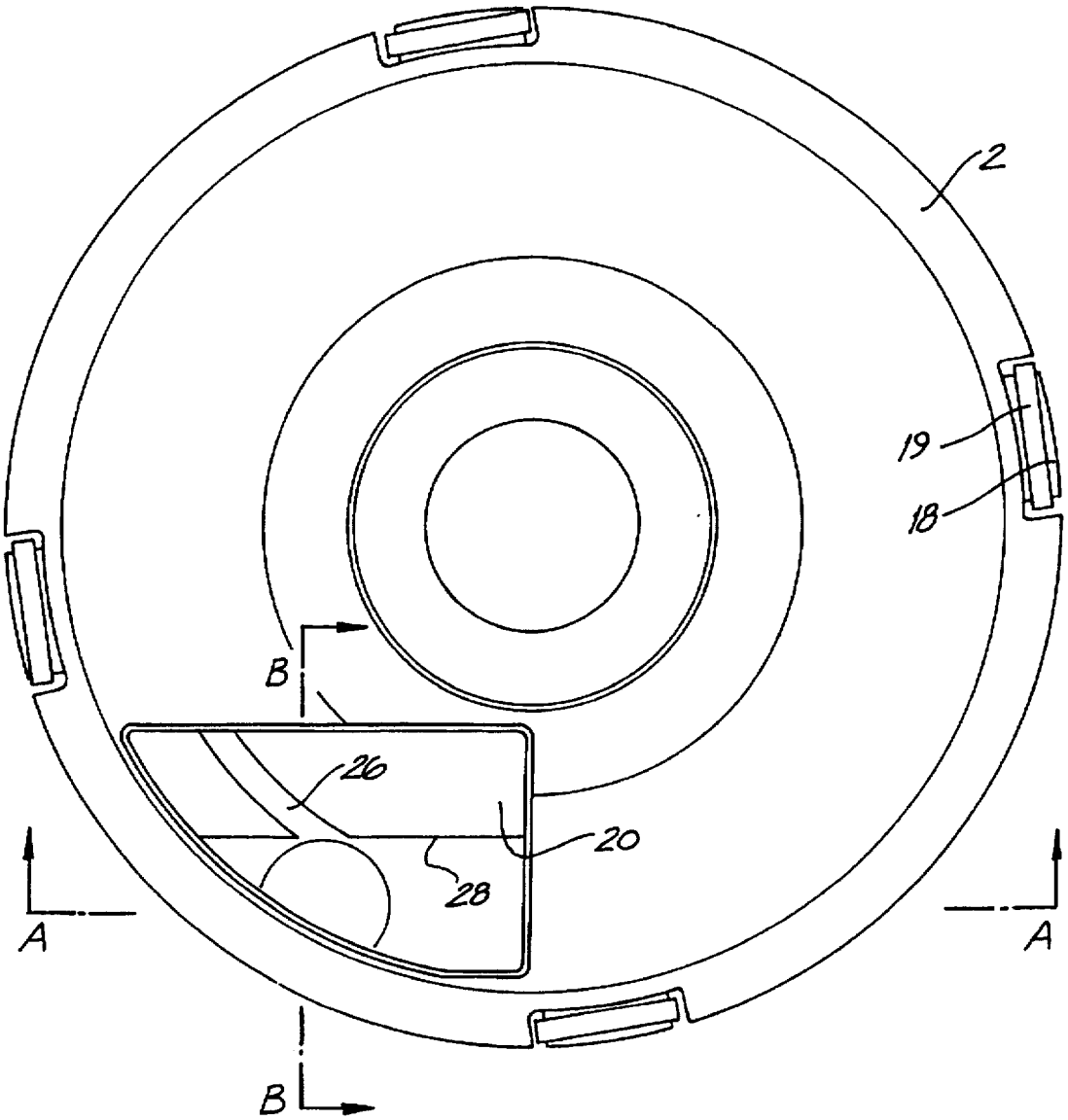
FIG. 5 is a plan view of the circular base.

As is best seen in FIG. 5 the exit plate may be constructed as a removable quadrant to cater for coins of differing diameters.

Figure 8:
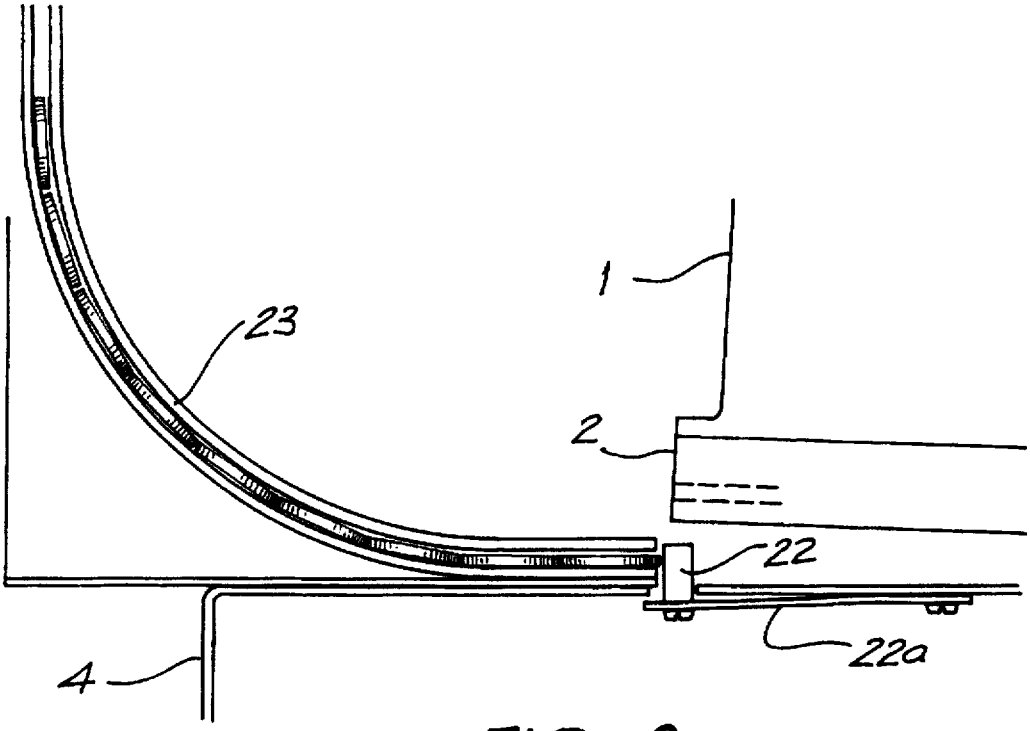
FIG. 8 illustrates the relationship between a vertical coin elevator and the coin storage and dispensing apparatus.
Figure 9:
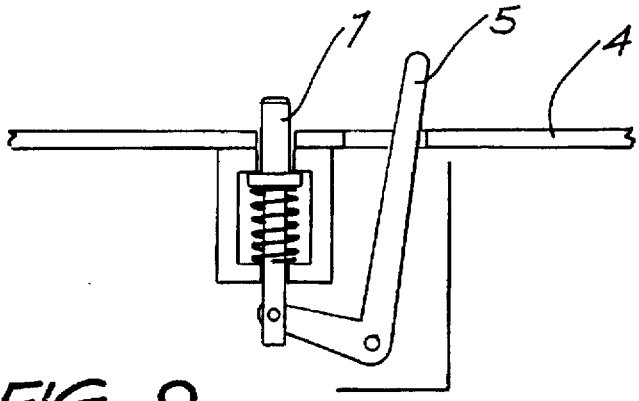
FIG. 9 is a side elevation of mechanism for locking the base against removal.

An apparatus according to the invention may be used in conjunction with an elevator 23 as shown in. FIG. 8 used to raise coins to a higher level. Such elevators are well known but have the problem that coins contained in the elevator run backwards by gravity when the coin dispenser, which is usually of the conventional type of tilted axis hopper, is removed.

To deal with this problem a blocking bar 22 is provided. This is carried on a leaf spring 22A and when the base 2 and coin hopper 1 are removed the blocking bar projects upwardly thus preventing the passage of coins out of the elevator 23 under the influence of gravity. When the base 2 is replaced the blocking bar 22 is depressed leaving free access of coins from the exit plate to the elevator 23.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A coin dispensing apparatus having a cylindrical hopper an axis of which extends vertically, the bottom of the hopper being closed by a base above which is arranged a rotatable coin disc having circumferentially spaced holes for the receipt of coins, the base being provided with a coin exit slot through which coins are delivered, the base begin supported on a plinth containing a driving motor and driving means for rotating the coin disc, the base being removably secured to the plinth from which it is adapted to be readily removed together with the hopper and the coin disc, means which on removal and replacement of the base from the plinth bring the coin disc automatically into engagement with the driving means in the plinth and means for adjusting the spacing between the coin disc and the base to permit use of the apparatus with coins of different thicknesses.

2. A coin dispensing apparatus as claimed in claim 1 wherein the means securing the hopper to the base are such as to permit the hopper to be attached to the base with the coin exit pointing in any one of a plurality of different directions to suit installation in any particular apparatus.

3. A coin dispensing apparatus as claimed in claim 1 wherein the hopper is provided with lifting handles to facilitate removal from and attachment of the hopper to the base.

4. A coin dispensing apparatus as claimed in claim 1 wherein the base is removably secured to the plinth by means of lugs on the underside of the bowl engaging key-hole slots in the base.

5. A coin dispensing apparatus as claimed in claim 1 wherein the means which on removal and replacement of the base from the plinth bring the coin disc automatically into engagement with the driving means in the plinth consists of an upwardly spring loaded member projecting from the base into a central upwardly tapering skirt on the underside of the coin disc which leads to a recess drivingly engageable by means on the projecting member.

6. A coin dispensing apparatus as claimed in claim 1 wherein the exit slot is associated with an exit plate acting to deflect coins driven by the rotating coin disc in a radial direction through the exit slot.

7. A coin dispensing apparatus as claimed in claim 1 wherein an elevator is arranged to receive coins merging from the exit slot, the elevator being constructed and arranged to raise coins to a higher level.

8. A coin dispensing apparatus as claimed in claim 7 wherein means are provided to prevent coins moving downwardly in the elevator under the influence of gravity.

* * * * *